US005518401A

United States Patent [19]

FitzGerald et al.

[11] Patent Number: 5,518,401

[45] Date of Patent: May 21, 1996

[54] NON-PYROTECHNIC CUES AND METHOD FOR AREA WEAPONS EFFECTS SIMULATION SYSTEM

[75] Inventors: Mark R. FitzGerald, Phoenix; Bruce E. Geren, Chandler; Edward P. Katarski, Mesa, all of Ariz.

[73] Assignee: Motorola, Inc., Schaumburg, Ill.

[21] Appl. No.: 235,732

[22] Filed: Apr. 29, 1994

[51] Int. Cl.[6] ..... F41A 33/00

[52] U.S. Cl. ..... 434/11; 434/16

[58] Field of Search ..... 434/11, 16; 395/2.79; 305/102

[56] References Cited

U.S. PATENT DOCUMENTS

| | | | |
|---|---|---|---|
| H1,451 | 6/1995 | Campagnuolo | 434/11 |
| 4,650,419 | 3/1987 | Francke et al. | 434/16 |
| 4,654,008 | 3/1987 | Elmore | 434/16 |
| 4,744,761 | 5/1988 | Doerfel et al. | 434/13 |
| 5,199,874 | 4/1993 | Campagnuolo et al. | 434/11 |

*Primary Examiner*—Allen R. MacDonald
*Assistant Examiner*—Carlos R. Villamar
*Attorney, Agent, or Firm*—Frank J. Bogacz

[57] ABSTRACT

Non-pyrotechnic cues are used with an area weapons effects system. These cues include sound devices, flashing lights and smoke deposition devices. A processor detects the required type of display from an input message and displays an appropriate sound to correspond to the type of weapon used. In addition, visual displays are coordinated with the audio display to provide simulated explosions with appropriate sounds ("bangs") and lights ("flashing lights") and smoke.

19 Claims, 4 Drawing Sheets

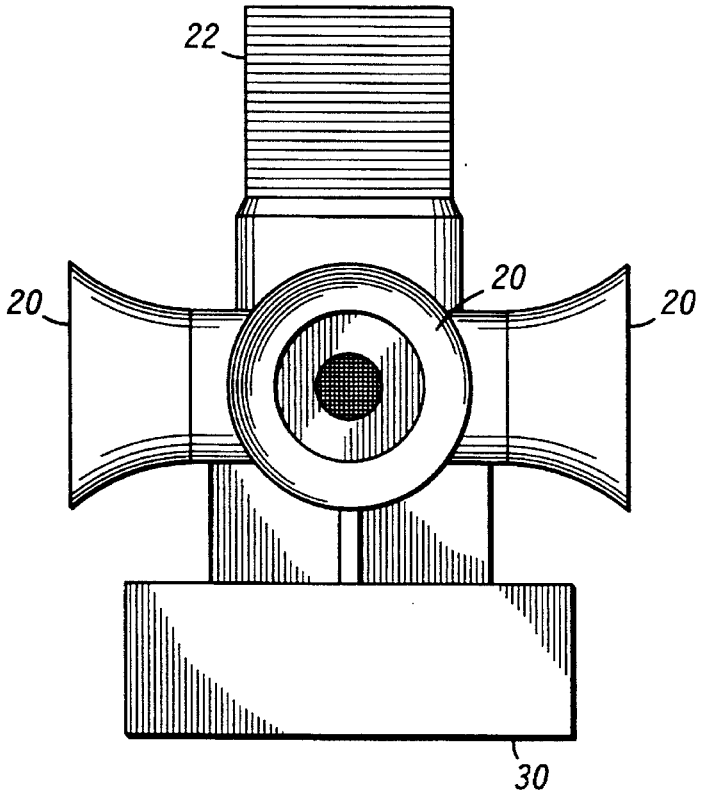
FIG. 2
FIG. 3
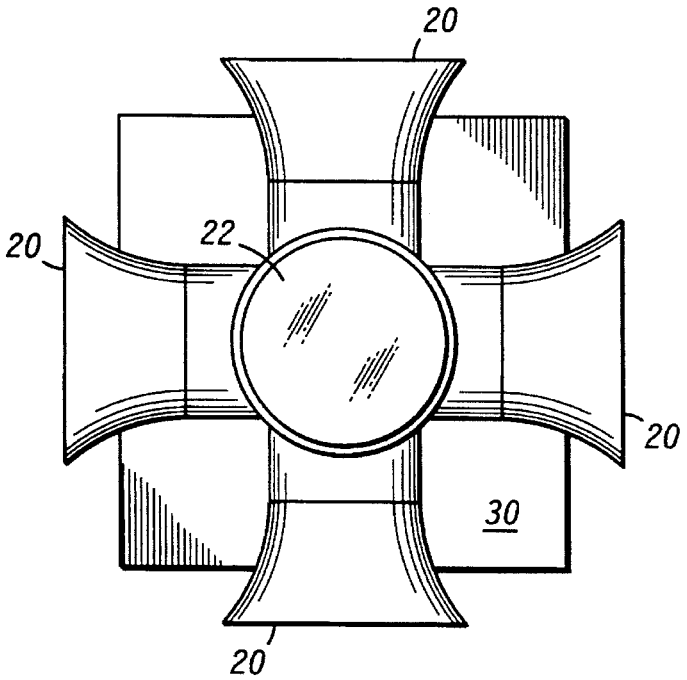

NON-PYROTECHNIC CUES AND METHOD FOR AREA WEAPONS EFFECTS SIMULATION SYSTEM

BACKGROUND OF THE INVENTION

The present invention pertains to area weapons effects simulation systems and more particularly to cues for the safe display of the results of weapon fire in simulated battlefield situations.

During military force-on-force training, such as at the US Army's National Training Center, a pyrotechnic device is used to provide audio and visual cues to players and observers that simulated indirect fire is occurring in their vicinity. The players observe the cues and can then respond accordingly. These pyrotechnic devices are detonated manually by an observer or automatically from a trigger signal from a vehicle or stationary cue that receives the simulated indirect fire missions.

A pyrotechnic device is an explosive which provides a flash and a bang. These explosives are dangerous to nearby personnel during detonation and also to personnel during storage, handling and transport. Pyrotechnic devices are also expended and must be replenished. Thus expense is incurred for replenishing the pyrotechnic devices and also for the storing, transporting, handling, and reloading of the pyrotechnic devices.

The response that a player can make to a pyrotechnic cue is limited since the cue makes no indication of the type of indirect fire is occurring in their vicinity. What is needed is more information on the type of indirect fire that is occurring so that the player can respond more intelligently.

BRIEF DESCRIPTION OF THE DRAWING

FIG. 2 is a side view of a non-pyrotechnic cue device in accordance with the present invention.

FIG. 3 is a top view of a non-pyrotechnic cue device in accordance with the present invention.

DESCRIPTION OF THE PREFERRED EMBODIMENT

The non-pyrotechnic cues of the present invention may be accomplished by using a strobe light and speakers. The strobe light would simulate the visual flash and the speakers would simulate the audible effects of a simulated weapon engagement. Operation of the non-pyrotechnic cue may be achieved automatically by using an Area Weapons Effect Simulation (AWES) event message in an AWES system such as the Combined Arms Training Integrated Evaluation System Detector Device manufactured by Motorola, Inc. through an electrical interface (such as RS-232) or manually.

Figure 1:
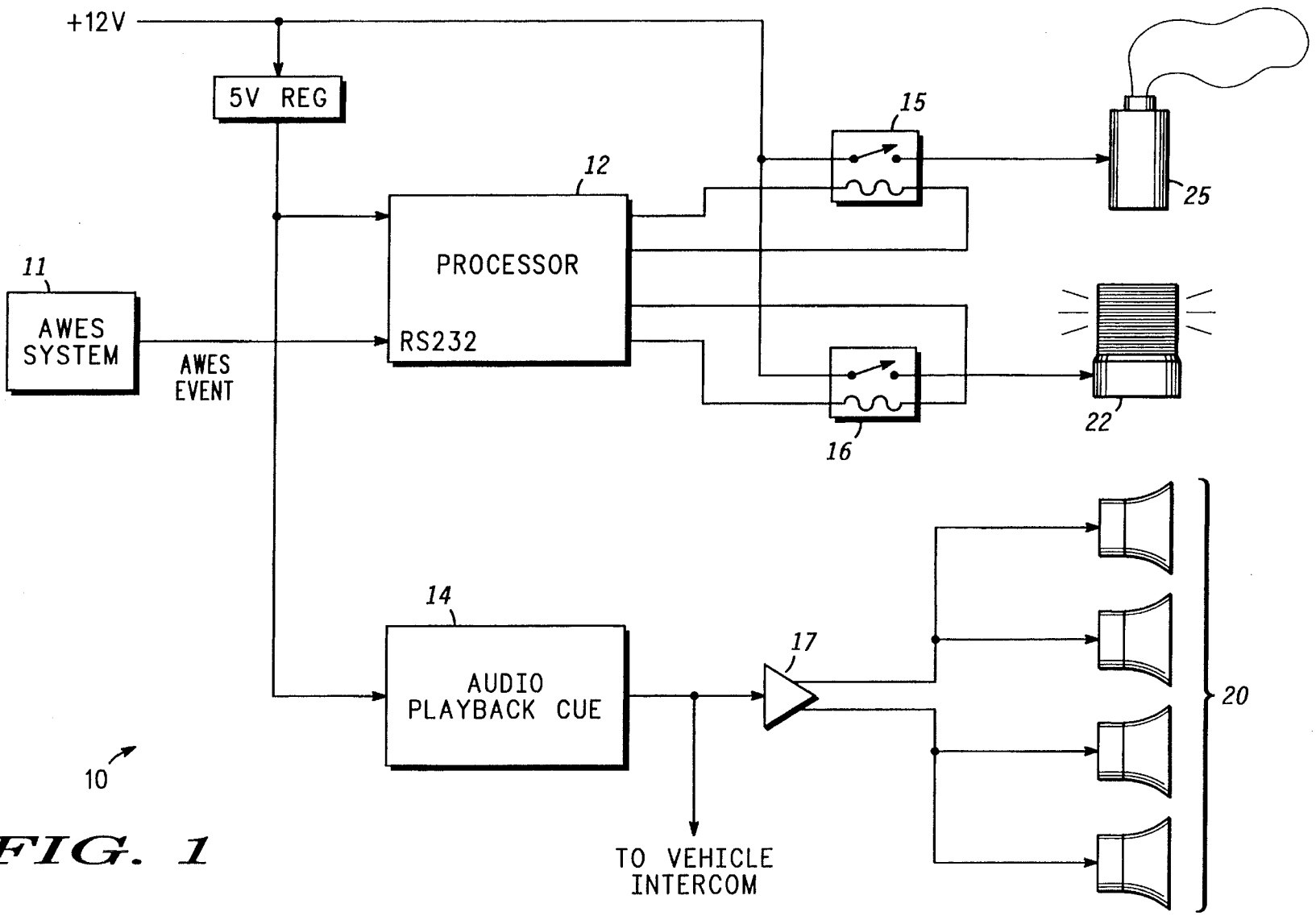
FIG. 1 is a block diagram of a non-pyrotechnic cue in accordance with a preferred embodiment of the invention.

FIG. 1 shows a block diagram of a non-pyrotechnic cue in accordance with a preferred embodiment of the invention. The non-pyrotechnic cue includes a processor 12 coupled to an audio playback cue 14. The audio playback cue 14 is coupled to an amplifier 17, which is coupled to four speakers 20. The processor 12 is also coupled to relay 15 and to relay 16. Relay 15 is coupled to an smoke pot cue 25, which may be an option in the AWES system. Relay 16 is coupled to a strobe light cue 22.

Referring to FIG. 1, an AWES system 11 receives indirect fire missions and assesses kills or near misses and sends an AWES event message via the AWES EVENT lead to the processor 12 of the non-pyrotechnic cue subsystem 10. The processor 12 receives the AWES event message and determines what type of cue to perform. If an audible signal is determined to be required by processor 12, then a message is sent to the audio playback cue 14. The audio playback cue then outputs one of several pre-recorded audio messages located in its memory to the amplifier 17, which is made audible by speakers 20. The audio messages are different weapons sounds. The choice of pre-recorded messages that are output is selected according to the message sent from processor 12. For example, if processor 12 knows that the weapon type is artillery, the message sent to the audio playback cue 14 would select the pre-recorded message that contains the sound of an artillery attack.

If a visual signal is determined to be required by processor 12, then processor 12 activates relay 16 which in turn activates the strobe light cue 22. A duration for the strobe light cue could be 4 seconds "on " for a near miss and infinitely "on"(until reset by either another AWES message or manually) for a kill, of a vehicle such as a tank. If a visual smoke signal is determined to be required by processor 12, then relay 15 is activated which in turn activates the smoke pot cue 25. Activation of the smoke pot cue would be for a kill condition only, for example.

Processor 12 may be implemented with a 68H C11 micro controller as manufactured by Motorola, Inc. or equivalents. Audio playback cue may be implemented with an audio playback cue board part number DV200 as manufactured by Palomar Telecom Inc. or with discrete components.

FIG. 2 shows a side view of a non-pyrotechnic cue. The speakers 20 are mounted on top of the electrical housing 30. The strobe light cue 22 is mounted above the speakers 20 and the electrical housing 30 to gain the most visibility when activated.

FIG. 3 shows a top view of a non-pyrotechnic cue in accordance the present invention. The strobe light cue 22 is shown mounted in the center of the electrical housing 30 with the 4 speakers 20 positioned around it at approximately 90 degrees to each other to obtain optimum sound dispersion.

Figure 4:
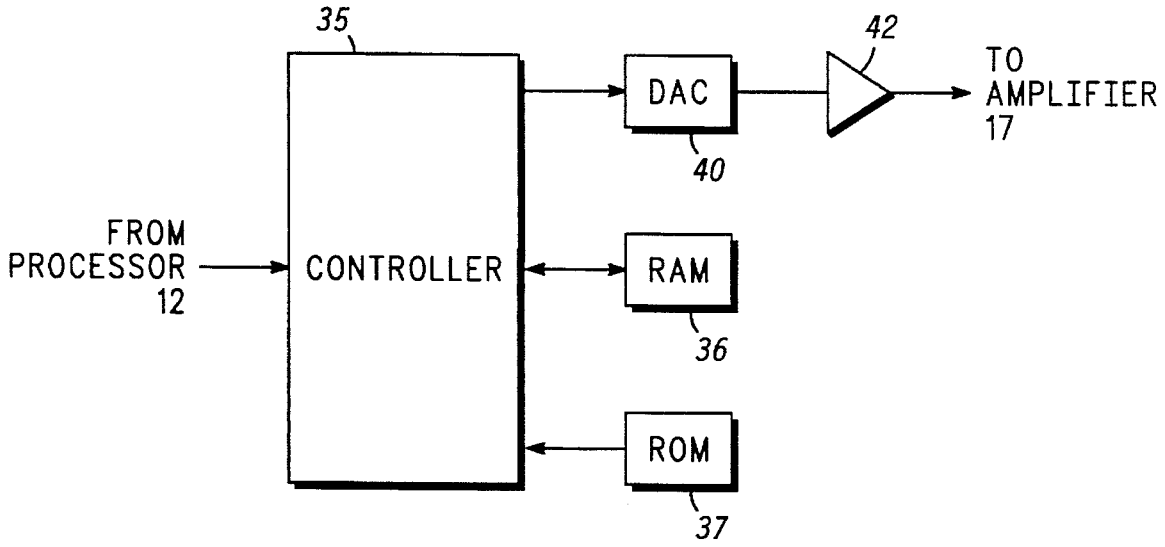
FIG. 4 is a block diagram of the audio playback cue 14 of FIG. 1 in accordance with the present invention.

FIG. 4 shows a block diagram of the audio playback cue 14 of FIG. 1 in accordance with a preferred embodiment of the invention. The audio playback cue is includes a controller 35, digital-to-analog converter (DAC) 40, read only memory (ROM) 37, random access memory (RAM) 36, and an amplifier 42.

The controller 35 receives messages from processor 12 of FIG. 1. The controller 35 reads a pre-recorded message from either RAM 36 or ROM 37 (or some other storage device such as a compact disc player or a audio tape drive) according to the message received. The controller 35 then sends the message to the DAC 40. The message is then amplified through the amplifier 42 and the message is then sent to amplifier 17 of FIG. 1 to drive speakers 20.

Although the preferred embodiment of the invention includes of a processor 12 and audio playback cue 14, the audio playback cue 14 and processor 12 could be combined to form a single entity.

Figure 5:
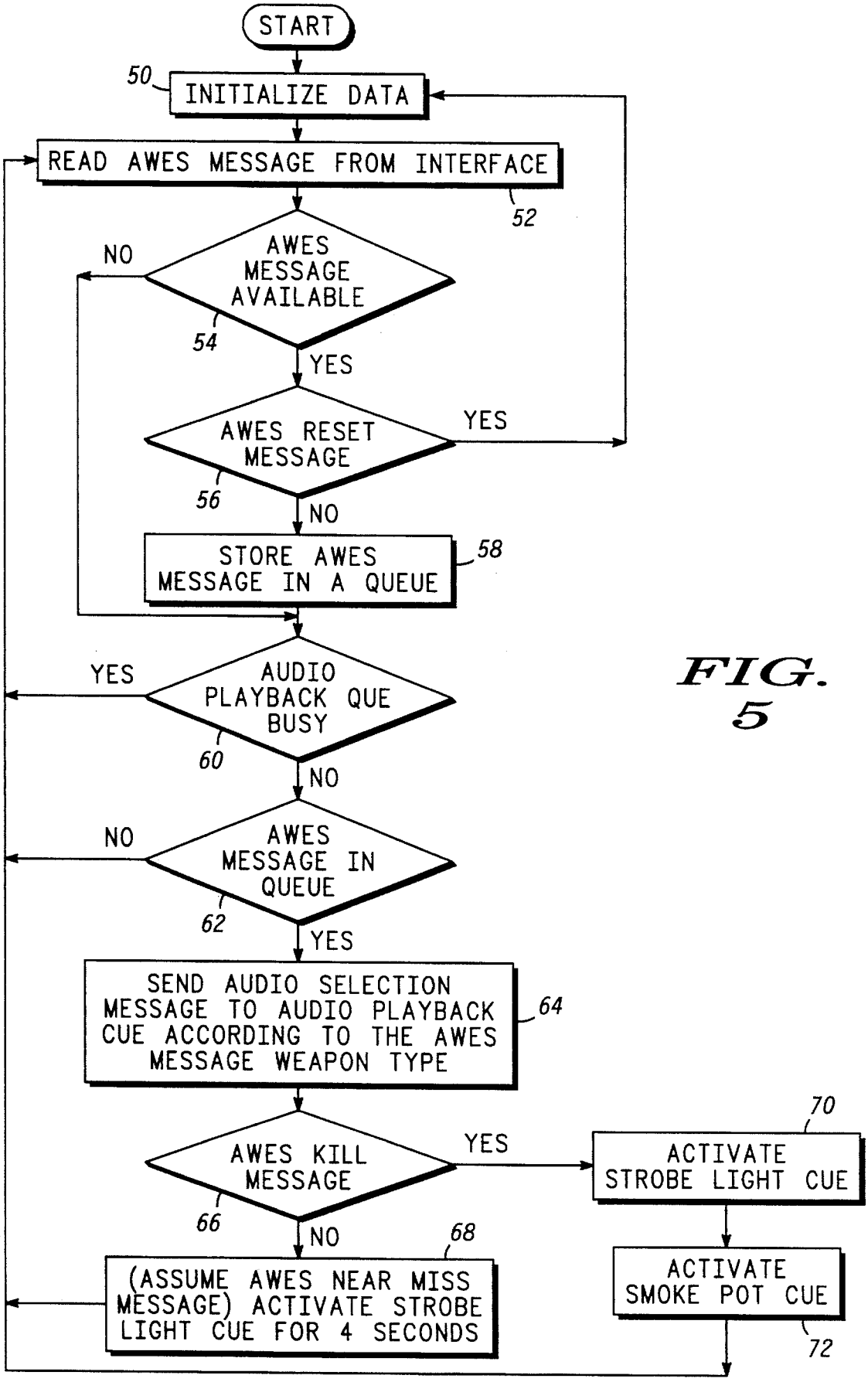
FIG. 5 a flow diagram of the operation of processor 12.

FIG. 5 shows a preferred flow diagram of processor 12. The non-pyrotechnic cue offers the same capabilities as with the pyrotechnic devices with several advantages. The non-pyrotechnic cue is safe for operating and transporting by personnel. Since the non-pyrotechnic cue can operate from rechargeable batteries or vehicle power, there are no recurring costs and logistics support is greatly reduced. The audible sounds are programmable allowing a user to choose various sounds depending on applicable weapon types.

FIG. 5 is a flow diagram of the operation of processor 12. The process is started and the start block is entered. The start block transfers control to block 50 which initializes various internal data. Next, block 52 reads an AWES message from an AWES system 11 of FIG. 1 via the RS-232 interface as shown in FIG. 1. Then block 54 determines whether an AWES message is available from the system 11 of FIG. 1. If no AWES message is available block 54 transfers control to block 60 via the NO path. If an AWES message is available from the system 11 of FIG. 1, block 54 transfers control to block 56 via the YES path.

Block 56 determines whether the message is an AWES reset message. If the message is an AWES reset message, block 56 transfers control to block 50 via the YES path so that block 50 can initialize the internal data. If the message is not an AWES reset message, block 56 transfers control to block 58. Block 58 stores the AWES message in a queue (list of messages).

Block 60 determines whether the audio playback cue is busy. If the audio playback cue is busy, block 60 transfers control to block 52 via the YES path and block 52 reads another message from the AWES interface. If the audio playback cue is not busy block 60 transfers control to block 62 via the NO path.

Block 62 determines whether there is a message in the audio playback queue. If there is no message in the audio playback queue, block 62 transfers control to block 52 via the NO path and block 52 reads another message from the AWES system 11. If there is a message in the audio playback queue, block 62 transfers control to block 64 via the YES path.

Block 64 sends an audio message selection message to the audio playback cue according to the weapon type specified in the AWES message received. For example an artillery weapon may have been specified in the message. As another example a mortar may be indicated. The appropriate weapon sound is presented through speakers 20.

Next, block 66 determines whether a "kill " condition is specified in the AWES message. If a "kill " condition is not specified, a "near miss " condition is assumed to have been requested and block 66 transfers control to block 68 via the NO path. As a result, block 68 activates strobe light 22 for approximately four seconds indicating that some damage has occurred and a "near miss " condition exists. Block 68 then transfers control to block 52 to read another AWES message from the system 11 of FIG. 1.

If block 66 determined that a "kill " condition is requested, block 66 transfers control to block 70 via the YES path. Block 70 activates the strobe light cue 22 until instructed to reset. This indicates that the target has been destroyed. Next, block 72 activates the smoke pot cue 25 which releases a smoke cloud which simulates the smoke and fire which represent a complete destruction of the target. Block 72 then transfers control to block 52 to read another AWES message from the interface.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. Non-pyrotechnic cues for an area weapons effects simulation system comprising:

an area weapons effects system for providing a message which indicates a weapon type and an effect of said weapon type on a target;

a processor for translating said effect of said weapon type into an identity of at least one cue, said processor coupled to said area weapons effects system;

an audio playback cue for producing a sound related to said weapon type in response to a selection of an audio cue, said audio playback cue coupled to said processor; and a visual cue for display visual indications of said effect of said weapon type on said target, said visual cue coupled to said processor.

2. Non-pyrotechnic cues for an area weapons effects simulation system as claimed in claim 1, wherein there is further included at least one loud speaker for producing said sound related to said weapon type.

3. Non-pyrotechnic cues for an area weapons effects simulation system as claimed in claim 2, wherein said at least one loud speaker includes a plurality of loud speakers mounted so as to project said sound outward in a plurality of directions from a central location.

4. Non-pyrotechnic cues for an area weapons effects simulation system as claimed in claim 3, wherein said plurality of loud speakers includes four loud speakers mounted at a central location at approximately 90° with respect to one another.

5. Non-pyrotechnic cues for an area weapons effects simulation system as claimed in claim 4, wherein there is further included a first amplifier for driving each of said speakers, said amplifier coupled between an audio playback cue unit and said speakers.

6. Non-pyrotechnic cues for an area weapons effects simulation system as claimed in claim 5, wherein said audio playback cue includes a controller for selecting a recording in response to a message from said processor and said controller for playing back said recording, said controller coupled to said processor.

7. Non-pyrotechnic cues for an area weapons effects simulation system as claimed in claim 6, wherein said audio playback cue further includes a digital-to-analog converter for converting said recording stored in digital form to analog form, said digital-to-analog converter coupled to said controller.

8. Non-pyrotechnic cues for an area weapons effects simulation system as claimed in claim 7, wherein said audio playback cue further includes random access memory for storing said recordings in digital form, said random access memory coupled to said controller.

9. Non-pyrotechnic cues for an area weapons effects simulation system as claimed in claim 7, wherein said audio playback cue further includes read only memory for storing said recordings in digital form and for storing operating instructions for said controller, said read only memory coupled to said controller.

10. Non-pyrotechnic cues for an area weapons effects simulation system as claimed in claim 7, wherein said audio playback cue further includes a second amplifier for amplifying said converted digital-to-analog recording, said second amplifier coupled between said digital-to-analog converter and said first amplifier.

11. Non-pyrotechnic cues for an area weapons effects simulation system as claimed in claim 1, wherein said visual cue includes a light which is turned on under control of said processor for indicating weapons effects, said light coupled to said processor.

12. Non-pyrotechnic cues for an area weapons effects simulation system as claimed in claim 11, wherein:

said light includes a strobe light; and said visual cue further includes a relay for operating said strobe light, said relay coupled between said processor and said strobe light.

13. Non-pyrotechnic cues for an area weapons effects simulation system as claimed in claim 1, wherein said visual cue further includes:

a smoke pot for dispersing smoke in response to said processor to represent a particular weapons effect, said smoke pot coupled to said processor; and a relay for operating said smoke pot for dispersing said smoke in response to said processor, said relay coupled between said processor and said smoke pot.

14. A method for non-pyrotechnic cue display for an area weapons effects simulation system comprising the steps of:

reading by a processor a message including a weapon type and an effect of said weapon type on a target from an area weapons effects simulation system;

sending by the processor a selection message to an audio playback cue;

playing by the audio playback cue a selected one of a plurality of stored recordings; and lighting a light by a visual cue for a time period.

15. A method for non-pyrotechnic cue display for an area weapons effects simulation system as claimed in claim 14, wherein there is further included the steps of:

determining by the processor whether the message from the area weapons effects simulation system indicates a kill condition;

activating by the processor a strobe light, if a kill condition is determined; and activating a smoke pot, if a kill condition is determined.

16. A method for non-pyrotechnic cue display for an area weapons effects simulation system as claimed in claim 14, wherein there is further included the steps of:

determining by the processor whether the message received from the area weapons effects simulation system is a reset message; and initializing by the processor all data associated with the processor, if the message is a reset message.

17. A method for non-pyrotechnic cue display for an area weapons effects simulation system as claimed in claim 16, wherein there is further included the step of storing in a queue the message from the area weapons effects simulation system, if the message is not a reset message.

18. A method for non-pyrotechnic cue display for an area weapons effects simulation system as claimed in claim 17, wherein there is further included the steps of:

determining by the processor whether the audio playback cue is currently busy; and reading another message from the area weapons effects simulation system, if the audio playback cue is busy.

19. A method for non-pyrotechnic cue display for an area weapons effects simulation system as claimed in claim 18, wherein there is further included the steps of:

determining by the processor whether a message from the area weapons effects simulation system is in a queue, if the audio playback cue is not busy; and reading another message from the area weapons effects simulation system, if a message is not in the queue.

* * * * *